US010589159B2

(12) United States Patent
Pajonk-Taylor

(10) Patent No.: US 10,589,159 B2
(45) Date of Patent: Mar. 17, 2020

(54) WATER-FILLED PUNCHING BAG WITH PUNCH SENSOR ASSEMBLY

(71) Applicant: Taylor Made Group, LLC, Gloversville, NY (US)

(72) Inventor: Jason Pajonk-Taylor, Saratoga Springs, NY (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 189 days.

(21) Appl. No.: 15/611,247

(22) Filed: Jun. 1, 2017

(65) Prior Publication Data

US 2017/0348576 A1 Dec. 7, 2017

Related U.S. Application Data

(60) Provisional application No. 62/344,828, filed on Jun. 2, 2016.

(51) Int. Cl.
*A63B 69/20* (2006.01)
*A63B 71/06* (2006.01)

(52) U.S. Cl.
CPC ..... *A63B 69/205* (2013.01); *A63B 71/0622* (2013.01); *A63B 2220/17* (2013.01); *A63B 2220/30* (2013.01); *A63B 2220/40* (2013.01); *A63B 2220/53* (2013.01); *A63B 2220/56* (2013.01); *A63B 2220/62* (2013.01); *A63B 2225/20* (2013.01); *A63B 2225/50* (2013.01); *A63B 2230/75* (2013.01)

(58) Field of Classification Search
CPC ..... A63B 69/205; A63B 71/0622; A63B 2220/62; A63B 2220/30; A63B 2230/75; A63B 2225/20; A63B 2220/56; A63B 2220/17; A63B 2220/50; A63B 2225/53; A63B 2220/40; A63B 41/00; A63B 41/02; A63B 69/004; A63B 69/20; A63B 69/201; A63B 69/34; A63B 69/32; A63B 69/203; A63B 2220/51; A63B 2220/833; A63B 2243/00; A63B 2243/025; A63B 2243/0033; A63B 2243/0037; A63B 2243/0095; A63B 2244/10; A63B 2244/102; A63B 2244/104; A63B 2244/106
See application file for complete search history.

(56) References Cited

U.S. PATENT DOCUMENTS 2,767,920 A * 10/1956 Roberson ..... A63B 71/145 235/91 R
4,084,811 A * 4/1978 Kyo ..... A63B 69/004 273/DIG. 25

(Continued)

FOREIGN PATENT DOCUMENTS

WO WO-2008080626 A1 * 7/2008 ..... A63B 41/08

*Primary Examiner* — Sundhara M Ganesan
*Assistant Examiner* — Shila Jalalzadeh Abyaneh
(74) *Attorney, Agent, or Firm* — Nixon & Vanderhye P.C.

(57) ABSTRACT

A fluid-filled punching bag assembly includes an inflatable bag and a sensor assembly cooperable with the inflatable bag. The sensor assembly includes an impact sensor that is configured to detect impact with the inflatable bag. A processor communicating with the sensor assembly is programmed to process sensor data from the impact sensor.

13 Claims, 9 Drawing Sheets

(56) References Cited

U.S. PATENT DOCUMENTS 4,108,428 A * 8/1978 Winterbottom ..... A63B 69/20 482/84
4,208,048 A * 6/1980 Winterbottom ..... A63B 69/205 482/84
4,527,796 A * 7/1985 Critelli ..... A63B 21/0602 473/442
4,577,865 A * 3/1986 Shishido ..... A63B 43/00 473/446
4,883,271 A * 11/1989 French ..... A63B 24/0021 273/454
5,083,457 A * 1/1992 Schultz ..... B60C 23/0408 340/445
5,377,539 A * 1/1995 LaSalle ..... B60C 23/0496 73/146.8
5,755,634 A * 5/1998 Huang ..... A63B 43/00 473/570
6,582,330 B1 * 6/2003 Rehkemper ..... A63B 41/00 446/484
6,725,728 B1 * 4/2004 Lee ..... A61B 5/225 73/824
7,909,749 B2 3/2011 Sheedy
8,758,172 B2 * 6/2014 Creguer ..... A63B 71/0622 473/422
9,227,128 B1 * 1/2016 Carfagna, Jr. ..... A63B 69/32
9,517,384 B2 * 12/2016 Le ..... G06F 3/011
2002/0139288 A1 * 10/2002 Evans ..... B60C 23/02 116/34 R
2003/0216228 A1 * 11/2003 Rast ..... A63B 21/0087 482/84
2005/0266967 A1 * 12/2005 Considine ..... A63B 69/20 482/84
2006/0154758 A1 * 7/2006 Laliberty ..... A63B 41/00 473/593
2006/0229174 A1 * 10/2006 Bonutti ..... A63B 21/0004 482/111
2007/0193349 A1 * 8/2007 Petrucelli ..... B60C 23/0408 73/146.8
2008/0125293 A1 * 5/2008 Ng ..... A63B 69/32 482/84
2008/0220948 A1 * 9/2008 Publicover ..... A63B 41/00 482/77
2008/0276995 A1 * 11/2008 Ray ..... B60C 23/0408 137/227
2009/0048069 A1 * 2/2009 Sheedy ..... A63B 24/0006 482/8
2009/0176632 A1 7/2009 Wiber
2010/0083767 A1 * 4/2010 Kurtz ..... B60C 23/0408 73/724
2010/0130329 A1 5/2010 Sullivan et al.
2010/0184010 A1 7/2010 Perez
2011/0172060 A1 7/2011 Morales et al.
2012/0053016 A1 * 3/2012 Williamson ..... A63B 24/0062 482/8
2012/0058845 A1 * 3/2012 Crowley ..... A63B 41/00 473/604
2012/0184418 A1 * 7/2012 Wilson ..... A63B 21/00043 482/112
2013/0333459 A1 * 12/2013 Yu ..... B60C 23/0494 73/146.8

* cited by examiner

WATER-FILLED PUNCHING BAG WITH PUNCH SENSOR ASSEMBLY

CROSS-REFERENCES TO RELATED APPLICATIONS

This application claims the benefit of U.S. Provisional Patent Application No. 62/344,828, filed Jun. 2, 2016, the entire content of which is herein incorporated by reference.

STATEMENT REGARDING FEDERALLY SPONSORED RESEARCH OR DEVELOPMENT (NOT APPLICABLE)

BACKGROUND

The invention relates generally to an inflatable punching bag and, more particularly, to a water-filled punching bag for boxing training and/or fitness including an impact sensor assembly.

Punching bags are routinely used for boxing training and/or fitness exercises. Punching bags are typically inflated with air or sand. In a recent trend, water-filled punching bags are becoming more popular as the punching sensation more closely mimics hitting a human body. Additionally, the water-filled shell may be safer for a user's joints as the assembly better absorbs punches.

BRIEF SUMMARY

It would be desirable to provide a water-filled punching bag that incorporates a sensor assembly for tracking and measuring work rate, punching force and other statistics during a workout. The sensor assembly may be battery powered and mounted directly onto the bag at the valve/filling port. The sensor itself may be configured in the form of a tube that may extend into the bag through the valve/filling port to measure pressure changes when the bag is hit. The sensor may be calibrated for each bag size in order to correlate the pressure change to the force of the hit. The sensor may then send the data, via Bluetooth or the like, to a software application running on a smart device.

In an exemplary embodiment, a fluid-filled punching bag assembly includes an inflatable bag and a sensor assembly cooperable with the inflatable bag. The sensor assembly includes an impact sensor that is configured to detect impact with the inflatable bag. A processor communicating with the sensor assembly is programmed to process sensor data from the impact sensor. The inflatable bag may include a valve through which the inflatable bag is filled with fluid, where the impact sensor may be tube-shaped and may be positioned in the inflatable bag through the valve. The sensor assembly may further include a valve interface that is threaded into the valve to seal the valve. The sensor assembly may include a battery compartment.

The tube-shaped impact sensor may include a pressure transducer. The impact sensor may be configured to measure a pressure change within the inflatable bag upon impact. The pressure transducer may be calibrated according to a size of the inflatable bag to correlate the pressure change with an impact force. The fluid-filled punching bag may further include a data transmit device such as a Bluetooth adapter cooperable with the processor that outputs the sensor data processed by the processor to a remote device. The fluid-filled punching bag may further include a software application running on the remote device, where the software application generates a graphic user interface that displays at least one of the force of each impact, a number of impacts, impacts per minute, a total work out time, a round number, a start/stop button, calories burned, and number of steps. The software application may generate a graphic user interface that displays a number of power punches, the power punches being defined as an impact force exceeding a predetermined impact force based on a user weight class.

In another exemplary embodiment, a fluid-filled punching bag assembly includes an inflatable bag having a valve, and a sensor assembly cooperable with the inflatable bag. The sensor assembly includes an impact sensor that is configured to detect impact with the inflatable bag. The impact sensor may be a tube-shaped pressure transducer that is inserted into the inflatable bag through the valve. The sensor assembly may also include a threaded valve interface coupled with the impact sensor that is secured to the valve of the inflatable bag, and a processor communicating with the impact sensor and receiving sensor data output from the impact sensor.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
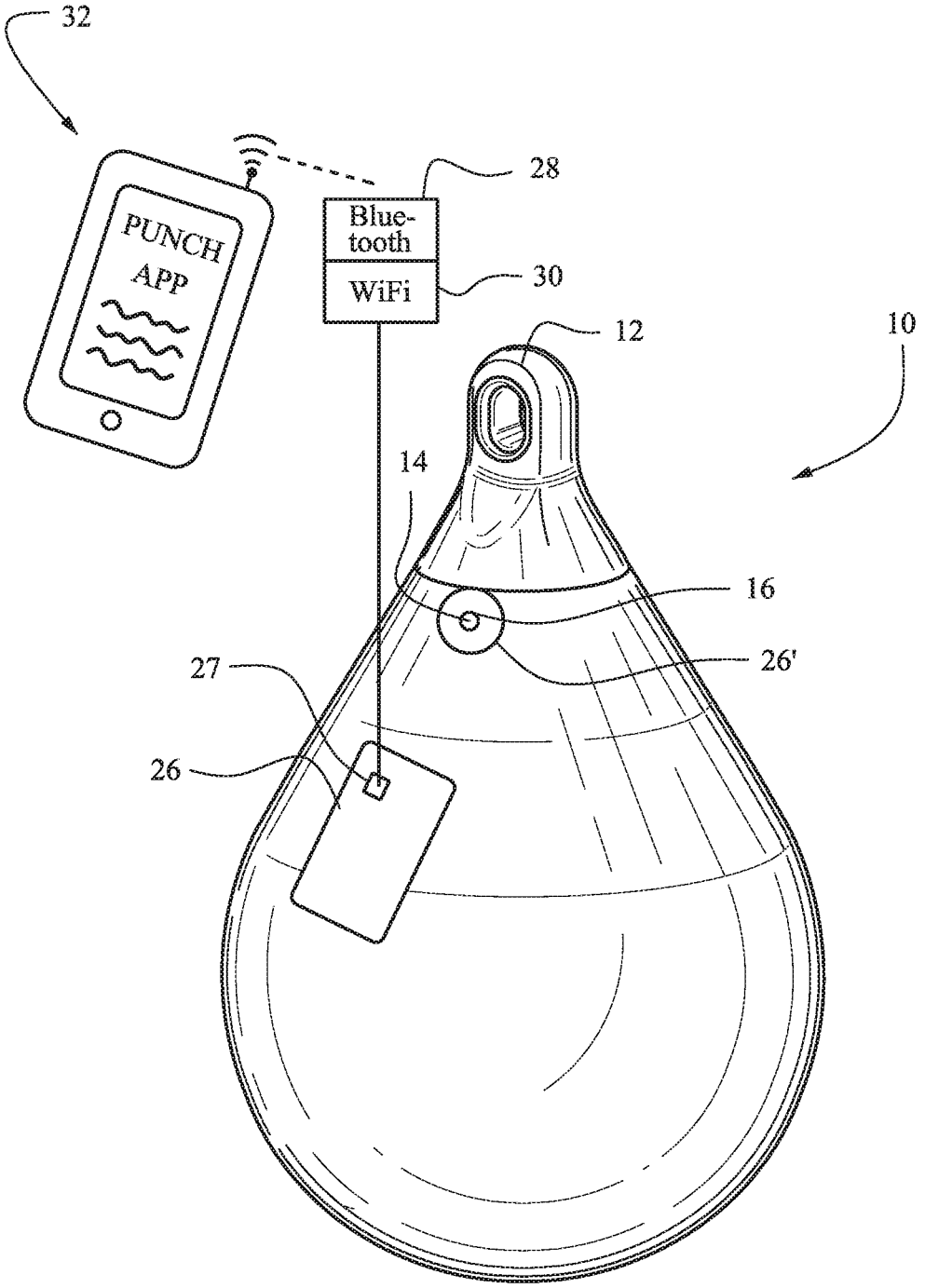
FIG. 1 shows a water-filled punching bag with schematically illustrated sensor components and communication technology.

With reference to FIG. 1, an inflatable bag 10 is generally formed in a teardrop shape with a rope eye 12 at a top end and a valve opening 14 sealed closed with a plug 16. In an exemplary embodiment, the inflatable bag 10 is rotationally molded vinyl and comprises a seamless construction.

The inflatable bag components may include a sensor assembly 26 for detecting impact with the inflatable bag 10. The sensor assembly 26 is shown schematically in FIG. 1. In an exemplary embodiment, with reference to FIG. 2, an alternative sensor assembly 26' may be integrated with the valve plug 16 and may incorporate a tube-shaped pressure transducer as an impact sensor 34 (see FIG. 2) that is inserted through the valve opening 14 into the cavity of the inflatable bag 10.

The alternative sensor assemblies 26, 26' may detect pressure changes or applications of force, such as by punching or the like, using any suitable technology. For example, the sensors may include pressure gauges, strain sensors, accelerometers, counters, etc. The sensor assembly 26 can be integrated into the inflatable bag exterior or may be otherwise positioned in an area where the inflatable bag 10 is intended to be punched. In yet another alternative embodiment, the sensor assembly may be structured and arranged to detect pressure changes throughout the bag or stress/strain on the bag material. In some embodiments, the sensor assembly 26, 26' can record the number of hits/punches in a predetermined time or during a workout session or the like. The sensor assembly 26, 26' may also record the force of impact of each hit.

Figure 2:
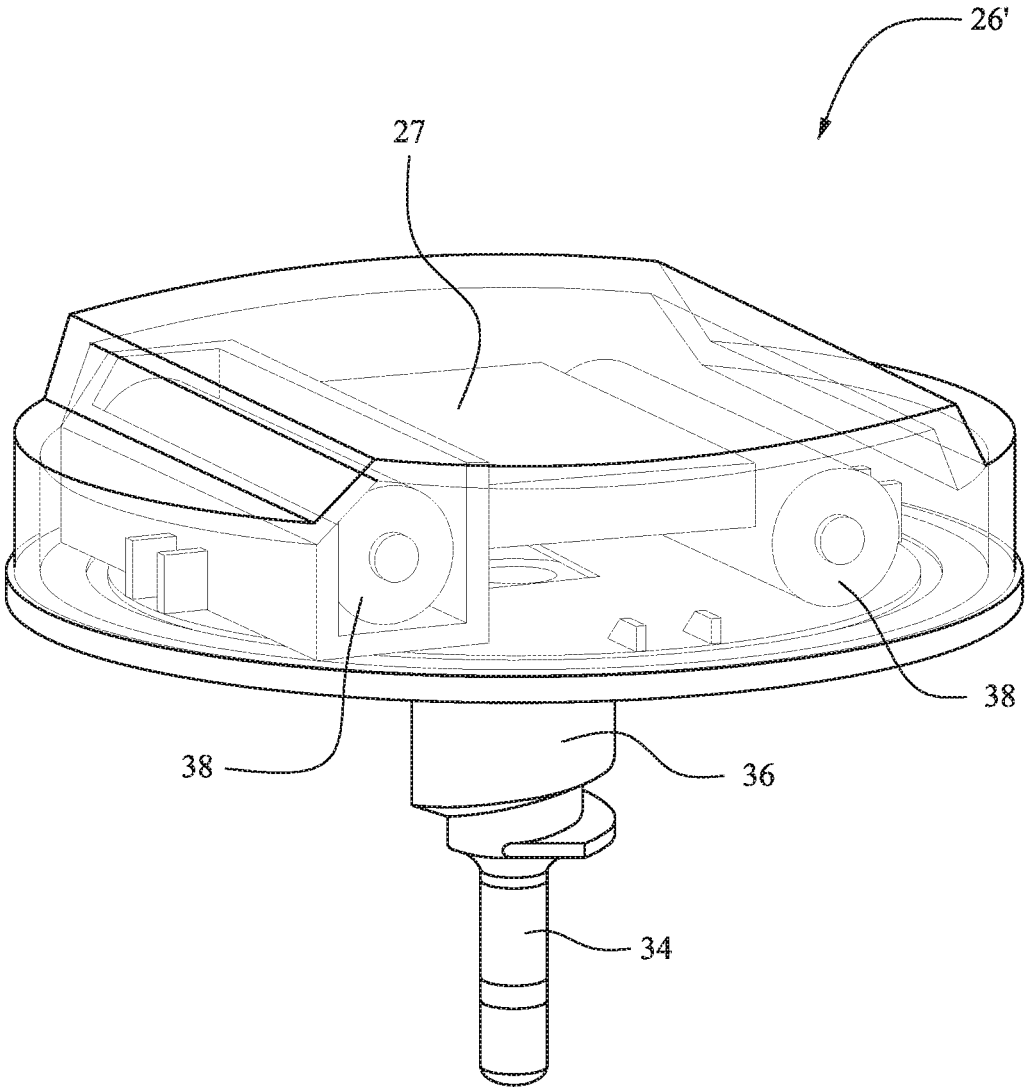
FIG. 2 is a detailed view of an exemplary sensor assembly.
Figure 3:
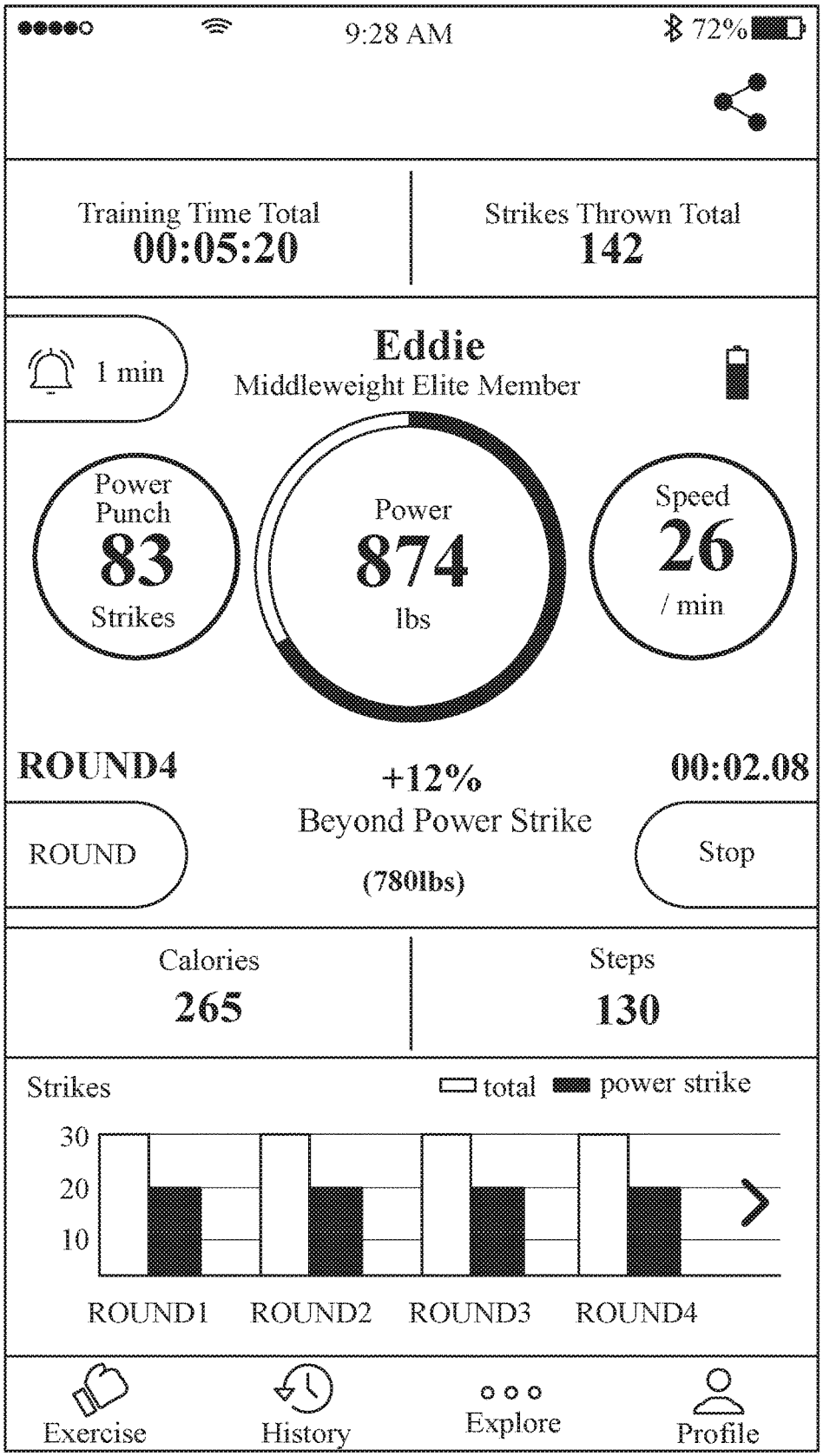
FIGS. 3-5C are exemplary screenshots from a smart device program/app associated with the punching bag and sensor assembly.
Figure 4A:
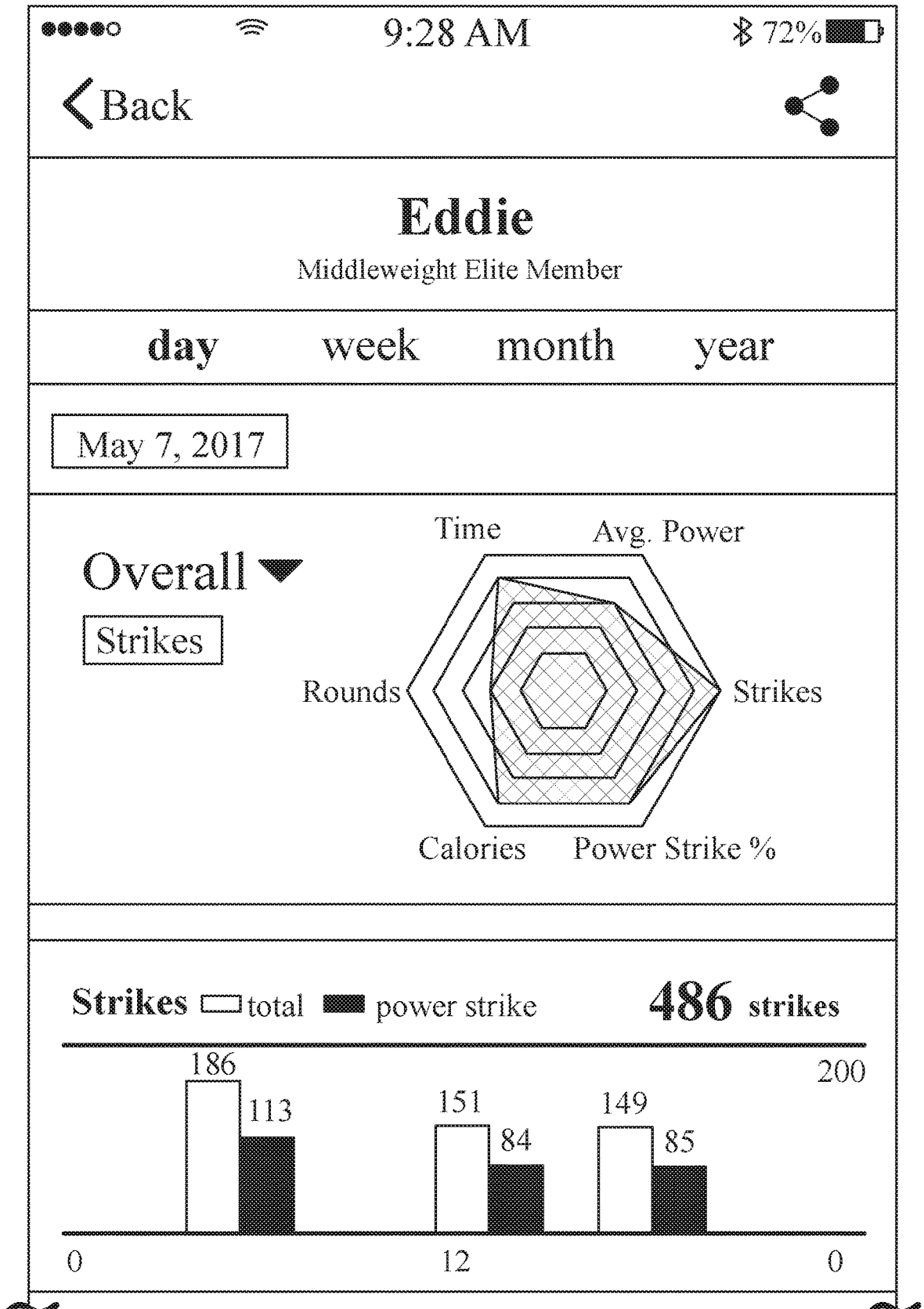
Figure 4B:
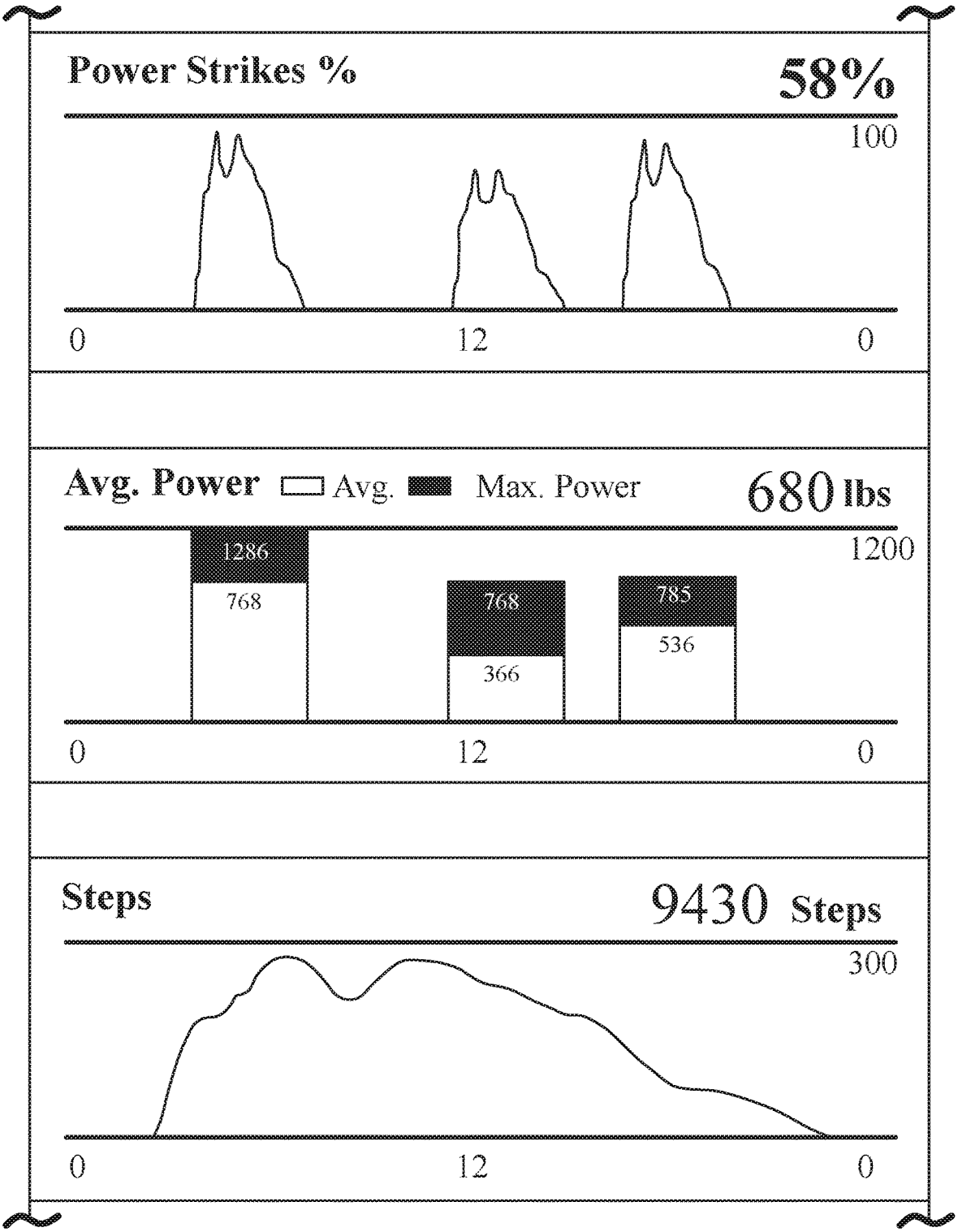
Figure 4C:
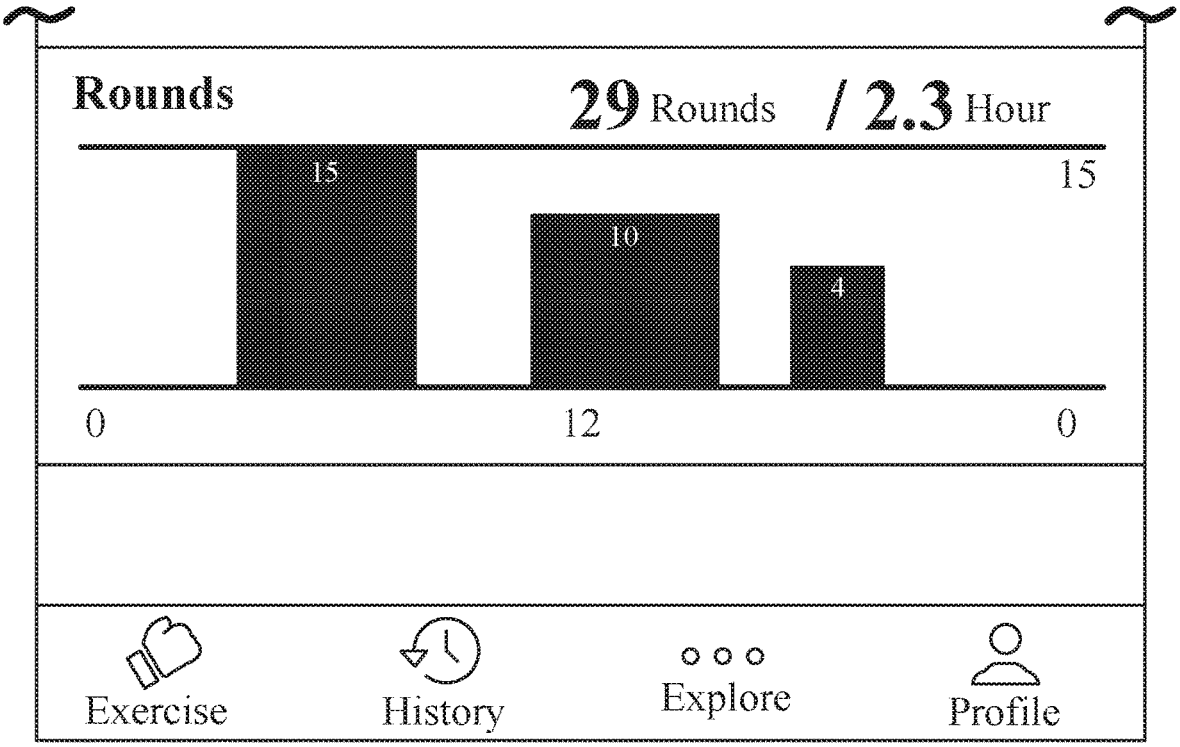
Figure 5A:
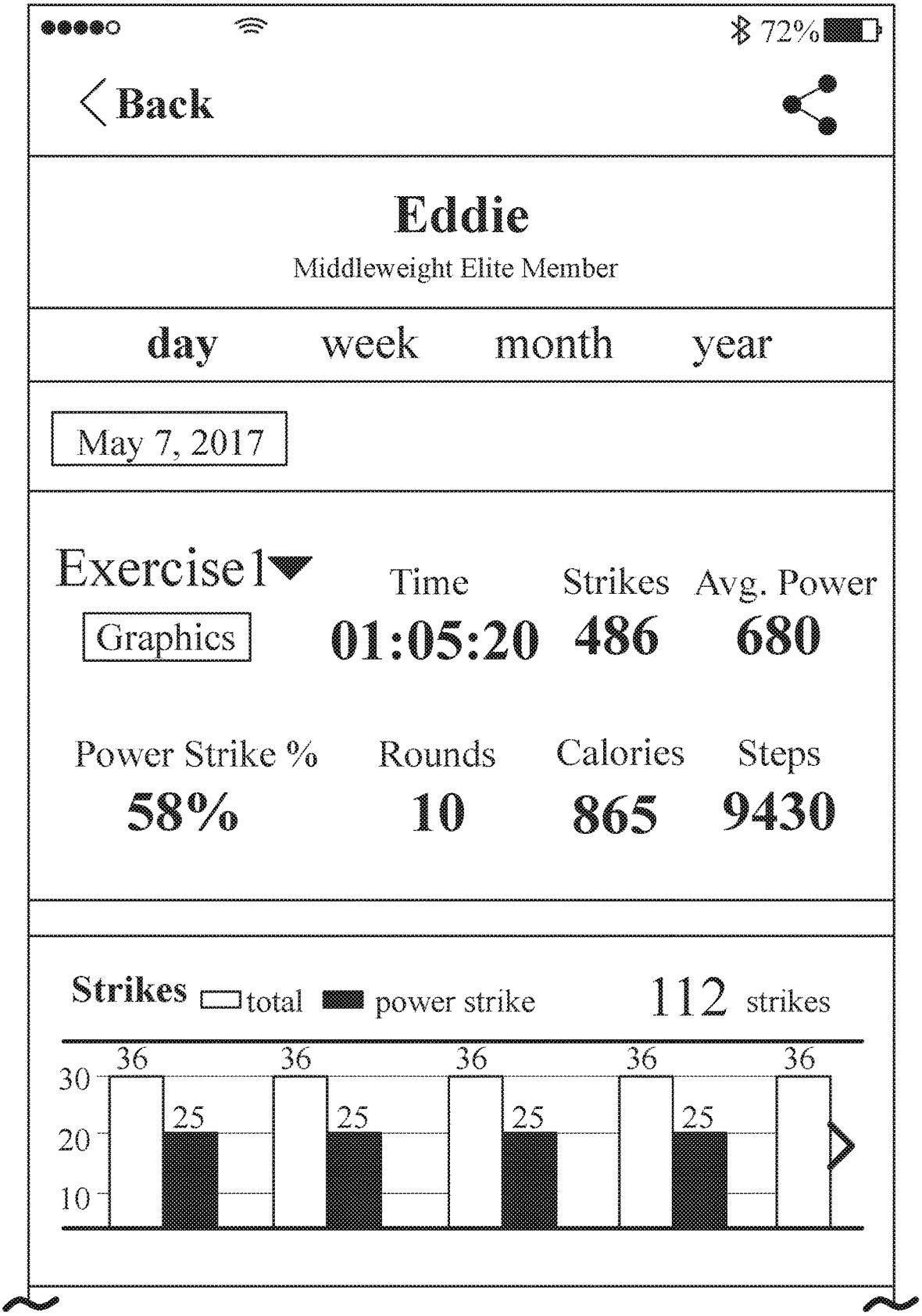
Figure 5B:
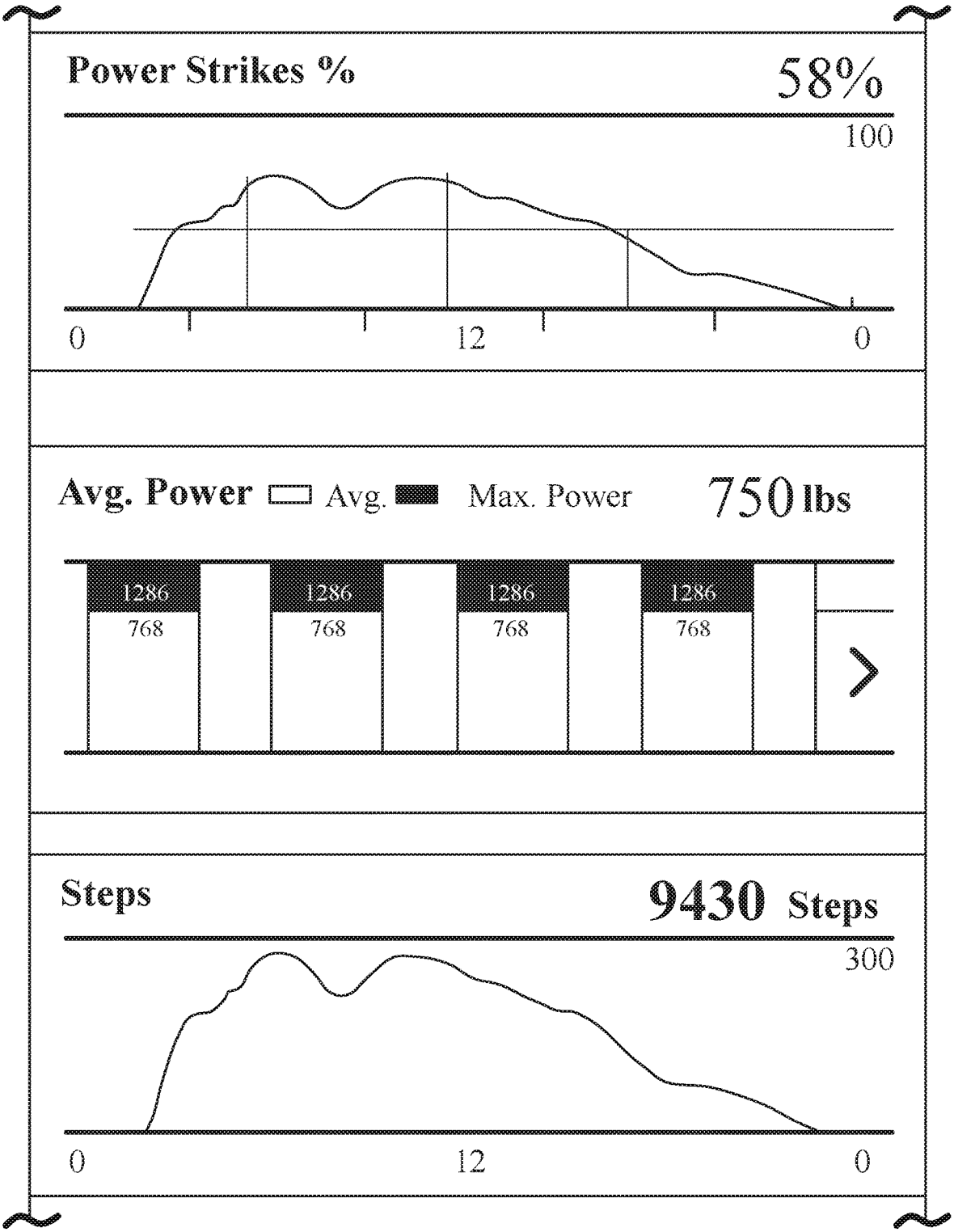
Figure 5C:
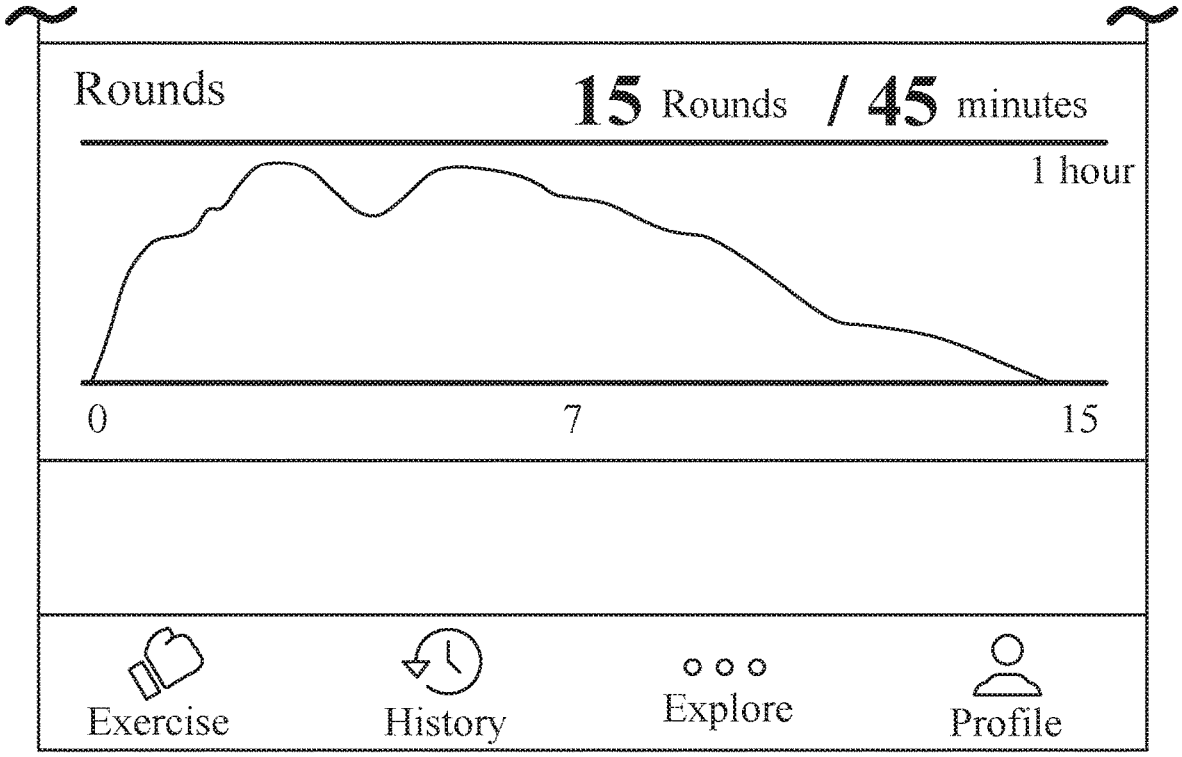

The processor 27, which may be separate from or form part of the sensor assembly 26, 26', is programmed to process sensor data from the impact sensor (e.g., sensor 34 in FIG. 2). A data transmit device such as a Bluetooth adapter/transmitter 28 or a Wi-Fi transmitter 30 is cooperable with the processor 27 and outputs the sensor data processed by the processor 27 to a remote device 32. For example, the data transmit device may deliver the data to a software application (i.e., an "app") running on a smart device 32 such as a smartphone or the like. Other communication technologies, such as ANT+ or the like, may be used as would be apparent to those of ordinary skill in the art. The app may be configured to manage and/or display data based on input from the sensor assembly 26, 26'. Additionally, the app may enable sharing data between users, keeping a history of workouts, personal records for speed, force, etc., posting workouts and results directly to social media etc.

FIG. 2 is a perspective view of an exemplary sensor assembly 26'. The sensor assembly 26' includes the impact sensor 34 in the form of a tube-shaped pressure transducer and a valve interface 36 that may be threaded directly into the valve 14 to seal the valve 14. In the embodiment shown in FIG. 2, the processor 27 forms part of the sensor assembly 26'. A battery compartment 38 receives one or more batteries for powering the assembly 26'. The data transmit device 28, 30 may similarly form part of the sensor assembly 26'.

In use, with the tube-shaped pressure transducer 34 inserted into the inflatable bag 10 through the valve 14 and with the valve 14 sealed by the valve interface 36, the impact sensor 34 is configured to measure a pressure change within the inflatable bag 10 upon impact. The impact sensor 34, such as the exemplary pressure transducer shown in FIG. 2, may be calibrated according to a size of the inflatable bag 10 to correlate the pressure change with an impact force. That is, a pressure inside the inflatable bag 10 will increase with an impact force applied to the outside of the bag 10. The sensor may be calibrated for each bag size since the pressure change will be different for each bag, even with the same impact force applied. For example, smaller bags will see larger pressure changes than larger bags at the same force.

The software application may be provided with a login screen, password recovery screen, user profile screen, and main activity screens. FIGS. 3-5C are exemplary screenshots of the graphical user interfaces generated by the software application associated with the smart device. As shown, the software application may cause the smart device to generate information from the data processed by the processor 27 associated with the sensor assembly 26, 26'. The activity screens may display at least one of the force of each impact, a number of impacts, impacts per minute, a total workout time, a round number, a start/stop button, calories burned, number of steps, etc. Additionally, the software application may cause the processor on the smart device to generate a graphic user interface that displays a number of power punches, which are defined as an impact force resulting from a punch that exceeds a predetermined impact force based on a user weight class. The software application may also have data summary screens showing graphical summaries of all of the data. Additional information and statistics may be processed by the software application as shown in FIGS. 4A-C and 5A-C.

The punching bag and sensor assembly of the described embodiments enables users to track and control exercise sessions. Users can compare data across workouts and challenge themselves to meet or exceed previous fitness and/or boxing objectives. The interface with a software application running on a smart device is user friendly and adds an entertainment component to user workouts.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A fluid-filled punching bag assembly comprising:

an inflatable bag having a valve; and a sensor assembly cooperable with the inflatable bag, the sensor assembly including:

an impact sensor that is configured to detect impact with the inflatable bag, the impact sensor being a tube-shaped pressure transducer disposed at a distal end of the sensor assembly that is inserted into the inflatable bag through the valve, a threaded valve interface integrally coupled with and directly adjacent the impact sensor on a valve side of the impact sensor, the threaded valve interface being secured to and sealing the valve of the inflatable bag, and a processor communicating with the impact sensor and receiving sensor data output from the impact sensor.

2. A fluid-filled punching bag assembly according to claim 1, wherein the impact sensor is configured to measure a pressure change within the inflatable bag upon impact.

3. A fluid-filled punching bag assembly according to claim 2, wherein the pressure transducer is calibrated according to a size of the inflatable bag to correlate the pressure change with an impact force.

4. A fluid-filled punching bag assembly according to claim 3, further comprising a data transmit device cooperable with the processor, the data transmit device outputting the sensor data processed by the processor to a remote device.

5. A fluid-filled punching bag assembly according to claim 4, further comprising a software application running on the remote device, the software application generating a graphic user interface that displays at least one of the force of each impact, a number of impacts, impacts per minute, a total work out time, a round number, a start/stop button, calories burned, and number of steps.

6. A fluid-filled punching bag assembly according to claim 5, wherein the software application generates a graphic user interface that displays a number of power punches, the power punches being defined as an impact force exceeding a predetermined impact force based on a user weight class.

7. A fluid-filled punching bag assembly according to claim 4, wherein the data transmit device comprises a Bluetooth adapter.

8. A fluid-filled punching bag assembly according to claim 1, wherein the sensor assembly further comprises a battery compartment for receiving batteries that power the impact sensor and the processor.

9. A fluid-filled punching bag assembly according to claim 8, wherein the sensor assembly further comprises a data transmit device cooperable with the processor, the data transmit device outputting the sensor data processed by the processor to a remote device.

10. A sensor assembly cooperable with an inflatable bag having a valve, the sensor assembly comprising:

an impact sensor that is configured to detect impact with the inflatable bag, the impact sensor being a tube-shaped pressure transducer that is insertable into the inflatable bag through the valve;

a threaded valve interface integrally coupled with and directly adjacent the impact sensor on a valve side of the impact sensor, the threaded valve interface being securable to and sealing the valve of the inflatable bag; and a processor communicating with the impact sensor and receiving sensor data output from the impact sensor.

11. A sensor assembly according to claim 10, further comprising a data transmit device cooperable with the processor, the data transmit device outputting the sensor data processed by the processor to a remote device.

12. A sensor assembly according to claim 11, wherein the data transmit device comprises a Bluetooth adapter.

13. A sensor assembly according to claim 10, further comprising a battery compartment for receiving batteries that power the impact sensor and the processor.

* * * * *